US009267283B1

(12) United States Patent
Kentz et al.

(10) Patent No.: US 9,267,283 B1
(45) Date of Patent: Feb. 23, 2016

(54) KIT FOR PRECAST PANELS AND METHOD OF ASSEMBLING PANELS

(71) Applicants: Thomas Kentz, Lacombe (CA); Del Grovet, Lacombe (CA); Fred Belt, Lacombe (CA)

(72) Inventors: Thomas Kentz, Lacombe (CA); Del Grovet, Lacombe (CA); Fred Belt, Lacombe (CA)

( * ) Notice: Subject to any disclaimer, the term of this patent is extended or adjusted under 35 U.S.C. 154(b) by 0 days.

(21) Appl. No.: 14/567,649

(22) Filed: Dec. 11, 2014

(51) Int. Cl.

| | |
|---|---|
| ***E04B 2/00*** | (2006.01) |
| ***E04C 2/04*** | (2006.01) |
| ***E04B 1/41*** | (2006.01) |
| *E04C 2/00* | (2006.01) |

(52) U.S. Cl.
CPC . *E04C 2/044* (2013.01); *E04B 1/40* (2013.01); *E04C 2002/001* (2013.01)

(58) Field of Classification Search
CPC ..... E01F 15/083; E04B 1/0015; E04C 3/34; E04C 2/044
USPC ..... 52/587.1, 430, 309.7
See application file for complete search history.

(56) References Cited

U.S. PATENT DOCUMENTS

| | | | | | |
|---|---|---|---|---|---|
| 1,983,020 | A | * | 12/1934 | De Vol | 52/384 |
| 3,279,135 | A | | 10/1966 | Jacobsen | |
| 3,621,626 | A | | 11/1971 | Tylius | |
| 3,732,653 | A | | 5/1973 | Pickett | |
| 3,734,451 | A | * | 5/1973 | Tierney | 249/192 |
| 4,111,401 | A | * | 9/1978 | Pickett | 256/13.1 |
| 4,194,333 | A | | 3/1980 | Paton et al. | |
| 4,282,692 | A | | 8/1981 | Potthast | |
| 4,669,240 | A | | 6/1987 | Amormino | |
| 4,781,006 | A | | 11/1988 | Haynes | |
| 4,819,394 | A | | 4/1989 | Compton | |
| 4,828,425 | A | * | 5/1989 | Duckett | 404/6 |
| 4,930,677 | A | | 6/1990 | Jolliffee | |
| 5,065,561 | A | * | 11/1991 | Mason | 52/309.12 |
| 5,096,333 | A | | 3/1992 | Bassett | |
| 5,174,909 | A | * | 12/1992 | Ward | 249/44 |
| 5,261,198 | A | | 11/1993 | McMillan | |
| 5,309,691 | A | * | 5/1994 | Tolliver et al. | 52/583.1 |
| 5,404,685 | A | * | 4/1995 | Collins | 52/309.7 |
| 5,421,558 | A | * | 6/1995 | Vesper | 256/31 |
| 5,440,845 | A | | 8/1995 | Tadros et al. | |
| 5,701,710 | A | * | 12/1997 | Tremelling | 52/426 |
| 5,887,404 | A | | 3/1999 | Kreizinger | |
| 6,151,856 | A | * | 11/2000 | Shimonohara | 52/426 |
| 6,230,462 | B1 | * | 5/2001 | Beliveau | 52/426 |
| 6,283,439 | B1 | * | 9/2001 | Myers et al. | 249/45 |
| 6,293,067 | B1 | * | 9/2001 | Meendering | 52/426 |
| 6,301,851 | B1 | * | 10/2001 | Matsubara | 52/430 |

(Continued)

FOREIGN PATENT DOCUMENTS

| | | |
|---|---|---|
| CA | 1214658 | 12/1986 |
| CA | 2090520 | 8/1993 |

(Continued)

*Primary Examiner* — Basil Katcheves
(74) *Attorney, Agent, or Firm* — Richard D. Okimaw

(57) ABSTRACT

A kit for connecting precast panels is disclosed herein. The kit includes at least two male member having a plate and a post projecting from the plate. The male member is operable to be embedded within a precast panel. The kit also includes at least two female members having a plate and a slot defined by the plate. Each female members is operable to be embedded within a precast panel. The post is received in the slot when the first precast panel and the second precast panel are slidably engaged with one another. Also disclosed is a precast panel formed using the kit and a method of connecting precast panels formed with the kit.

7 Claims, 7 Drawing Sheets

(56) References Cited

U.S. PATENT DOCUMENTS

| | | | | |
|---|---|---|---|---|
| 6,308,465 | B1 | 10/2001 | Galloway et al. | |
| 6,460,297 | B1 * | 10/2002 | Bonds et al. | 52/79.1 |
| 6,474,904 | B1 * | 11/2002 | Duckett et al. | 404/6 |
| 6,491,473 | B2 | 12/2002 | Veazey | |
| 6,767,158 | B1 * | 7/2004 | Consolazio et al. | 404/6 |
| 7,144,186 | B1 * | 12/2006 | Nolte | 404/6 |
| 7,861,479 | B2 * | 1/2011 | Crosby et al. | 52/426 |
| 8,341,788 | B2 | 1/2013 | Kim et al. | |
| 2002/0025221 | A1 * | 2/2002 | Johnson | 404/6 |
| 2003/0161683 | A1 * | 8/2003 | Lembo | 404/6 |
| 2005/0152744 | A1 * | 7/2005 | Straub | 404/6 |
| 2008/0098676 | A1 | 5/2008 | Hutchens | |
| 2011/0239581 | A1 | 10/2011 | Linares, III | |
| 2012/0090147 | A1 | 4/2012 | Paul | |
| 2012/0260567 | A1 | 10/2012 | Tupu | |

FOREIGN PATENT DOCUMENTS

| | | |
|---|---|---|
| CA | 2070623 | 12/1993 |
| CA | 2306130 | 7/1999 |

* cited by examiner 30
34
12
32
18
10

34
10
12
32
18

12
20
10

10
28
32

36
38
40
42
44
46
48
50
52
54
56
58

KIT FOR PRECAST PANELS AND METHOD OF ASSEMBLING PANELS

BACKGROUND OF THE INVENTION

1. Field of Invention

The invention relates to precast panels, such as concrete panel used in the construction of structures.

2. Description of Related Art

Precast concrete panel construction is a common construction technique in which precast concrete panels are shipped to and assembled at the building site. One common method of connecting the panels is to weld them together which is costly and very time consuming. Welding also does not allow for seismic movements.

U.S. Pat. No. 5,887,404 discloses a PRECAST CONCRETE WALL PANEL. The '404 patent discloses a wall system comprising a plurality of wall panels. Each panel has a vertically extending pilaster formed integrally with one end, defining a vertically open hollow core area of sufficient size for forming a concrete cast-in-situ column for supporting the panel in an upright position. The pilaster further includes an outwardly open groove communicating with the hollow core area. Each panel also has an integrally cast tongue projecting from its other said end, which is received in the groove of an adjoining panel to enclose the hollow core area. A concrete column is cast-in-situ in the hollow core area. Preferably, the pilaster is positioned on a concrete foundation or footing, which includes reinforcement members that project up into the hollow core area such that, when the column is cast, the reinforcement members are embedded in the concrete column. Adjoining panels may be positioned in end-to-end relation, at an angle relative to one another, or stacked.

SUMMARY OF THE INVENTION

According to a first embodiment of the present invention there is disclosed a kit for connecting precast panels comprising at least two male member having a plate and a post projecting from the plate, the post being operable to be embedded within a first precast panel. The kit further comprises at least two female members having a plate and a slot extending through the plate, the female member operable to be embedded within a second precast panel, wherein the post is received in the slot when the first and second precast panels are slidably engaged with one another.

The post may further comprise a threaded portion, a base portion having a first diameter and adjacent to the threaded portion, a head portion having a second diameter, and a neck portion disposed between the base portion and the head portion and having a third diameter less than the first diameter and less than the second diameter. The post may be threadingly engaged with the plate. The male members and the female members may further include first and second apertures disposed in transverse planes with respect to one another.

Each of the female members further comprises first and second apertures, wherein the first aperture and the second aperture are disposed in respective first and second planes that are transverse with respect to one another and wherein the slot is disposed in a third plane intersecting one of the first and second planes and parallel to the other of the first and second planes.

The slot further comprises an open end, a closed end spaced from the open end along a slot axis, a first length along the slot axis adjacent to the closed end having a first width perpendicular to the slot axis, and a second length along the slot axis extending between the first length and the closed end, wherein the second length has a varying width perpendicular to the slot axis.

According to a further embodiment of the present invention there is disclosed a precast panel formed with a kit for connecting precast panels comprising at least two male member having a plate and a post projecting from the plate, the post being operable to be embedded within a first precast panel. The kit further comprises at least two female members having a plate and a slot extending through the plate, the female member operable to be embedded within a second precast panel, wherein the post is received in the slot when the first and second precast panels are slidably engaged with one another. The precast panel comprises a front, a back spaced from the front by a thickness of the precast panel, a left edge extending between the front and back and a right edge extending between the front and back and spaced from the left edge by a width of the precast panel. The precast panel further comprises a top edge extending between the front and back and between the left edge and the right edge, a bottom edge extending between the front and back and between the left edge and the right edge and spaced from the top edge by a height of the precast panel, at least two male members embedded within the precast panel each having a first plate flush with one of the right or left edges and a post projecting therefrom and at least two first female members embedded within the precast panel each having a first plate and a first slot defined by the first plate flush with the other of the right or left edges.

According to a further embodiment of the present invention there is disclosed a method of assembling precast panels comprising the steps of positioning a first precast panel at a desired position and positioning a second precast panel adjacent to and offset above the first precast panel such that at least two posts project from a first edge of the second precast panel. The method further comprises engaging the at least two posts within corresponding slots defined by at least two female members embedded in the first precast panel; and moving the first precast panel in a downward direction to secure the first and second precast panels together.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figures 1, 2, 3, 4:
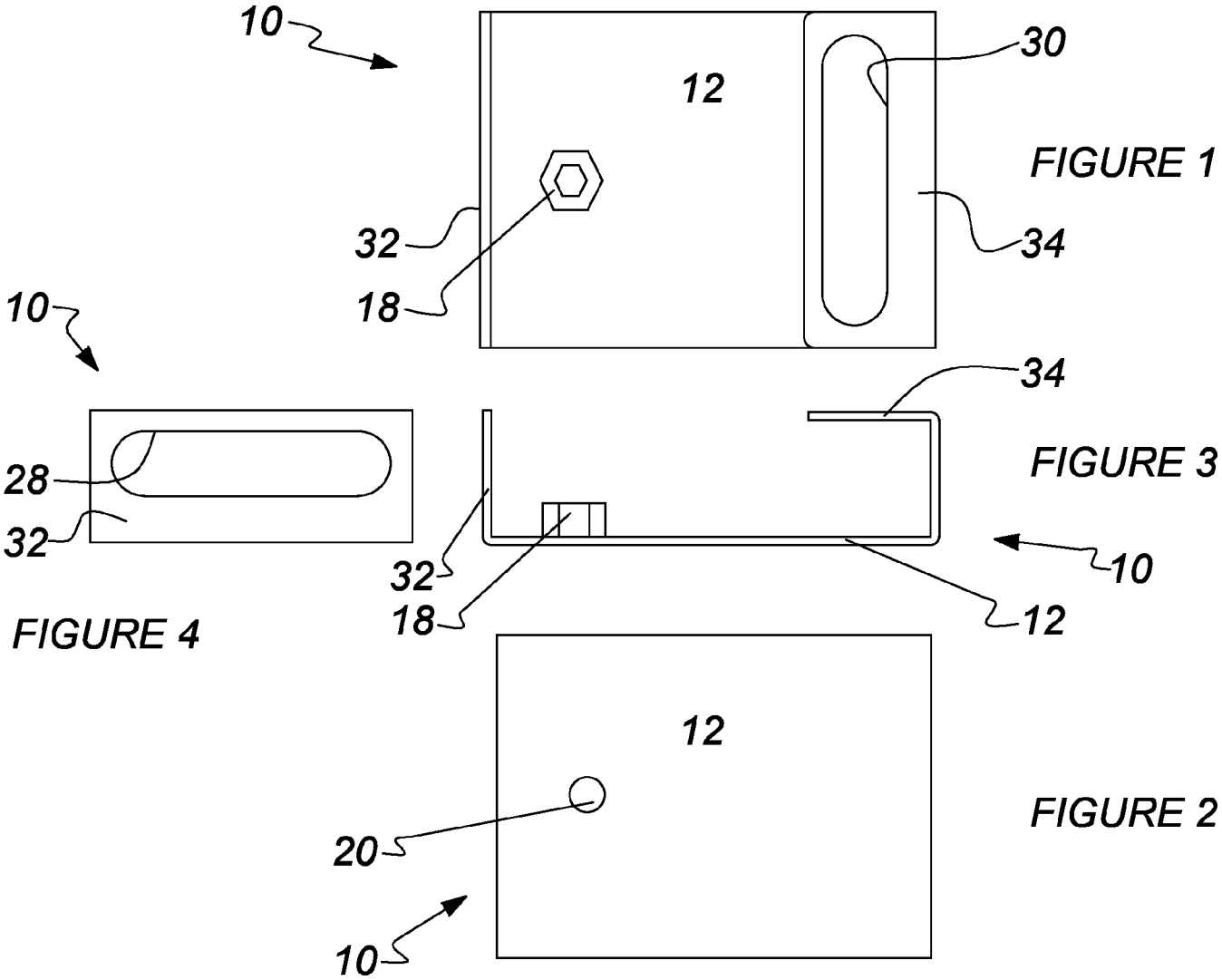
FIG. 1 is a bottom view of a male member according to an embodiment of the invention.
FIG. 2 is a top view of the male member shown in FIG. 1.
FIG. 3 is a side view of the male member shown in FIG. 1.
FIG. 4 is a front view of the male member shown in FIG. 1.
Figures 5, 6, 7, 8:
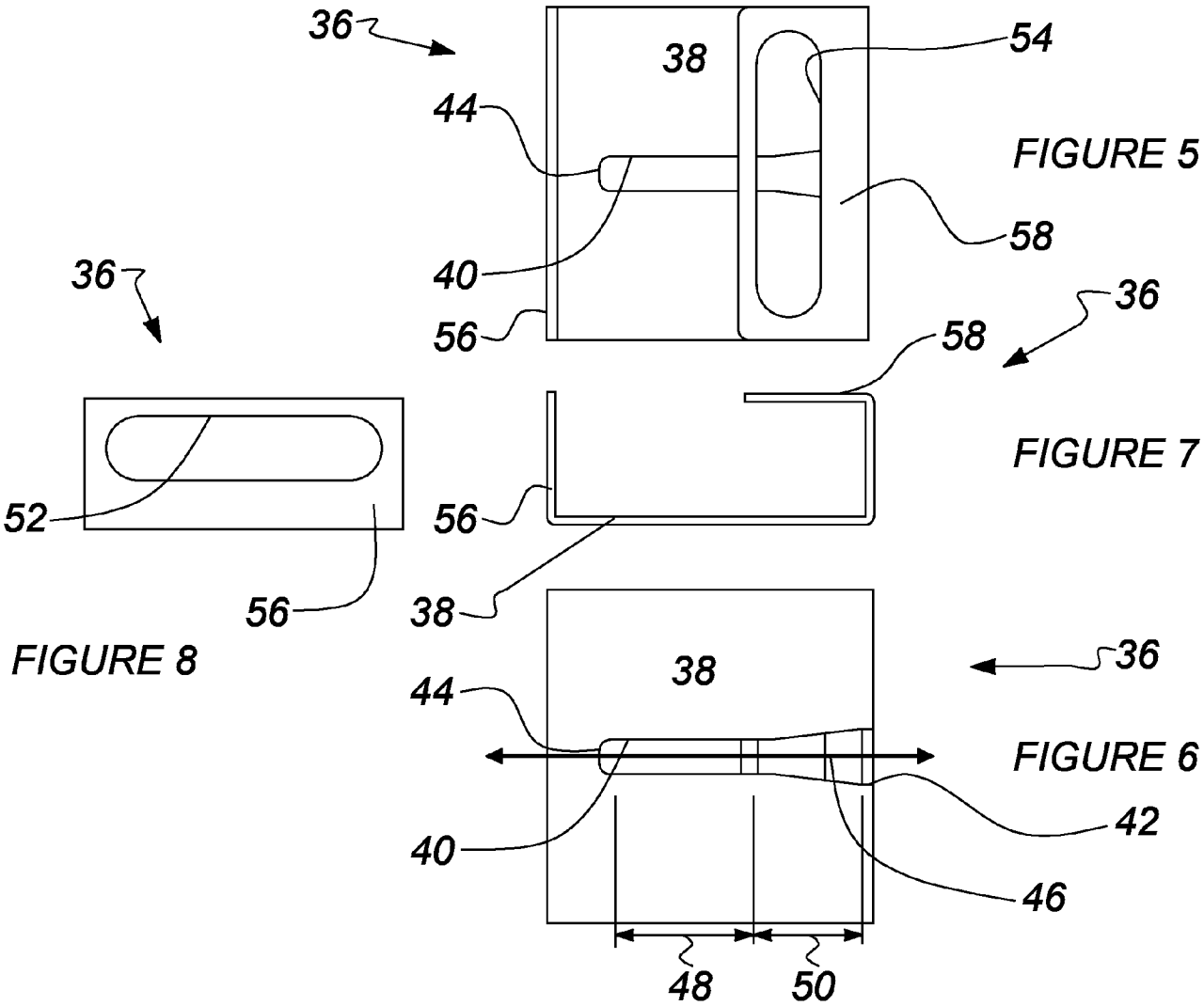
FIG. 5 is a back view of a female member according to an embodiment of the invention.
FIG. 6 is a top view of the female member shown in FIG. 5.
FIG. 7 is a side view of the female member shown in FIG. 5.
FIG. 8 is a front view of the female member shown in FIG. 5.

The invention, as demonstrated by the exemplary embodiment described below, can provide a very quick connection between panels in the concrete industry. These plates are cast within the forming of precast. The precast is shipped to site and ready for erection. On site, the panels need to be stood and connected into each other to create an envelope within. This device quickly allows the panels to be secure to each other, aligns panel to panel, connect panel to foundation.

The issues that have been solved by the exemplary embodiment are: easy form mounting, quick panel installation, no welding, safe, reliable, seismic issues and installation costs drastically reduced.

FIGS. 1-9 show exemplary components for one embodiment of the broader invention. The kit includes at least two male members 10 and at least two female member 36. FIGS. 1-4 and 9 show an exemplary male member 10. The male member 10 includes a plate 12 and a post 14 (FIG. 9) projecting from the plate 12. The male member 10 is operable to be embedded within a precast panel when the precast panel is formed.

Figure 9:
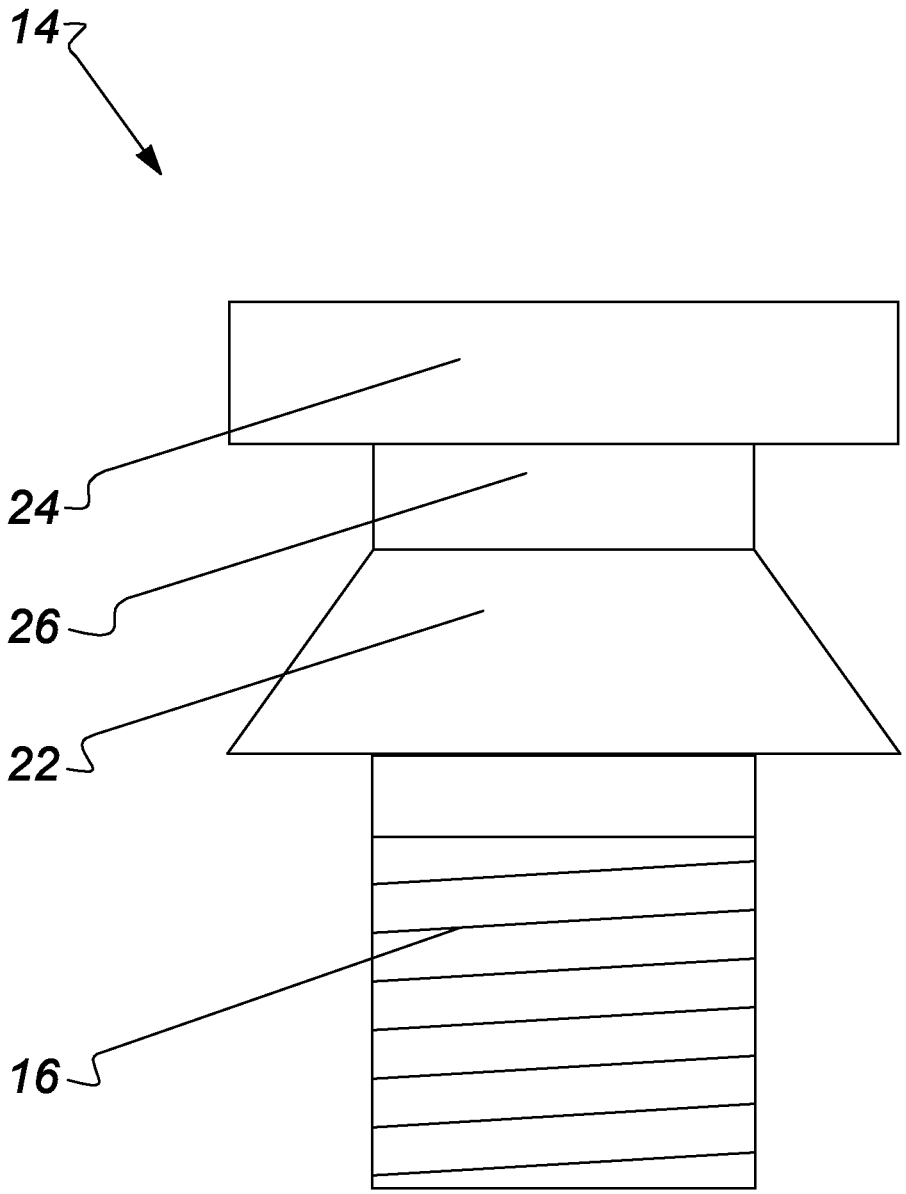
FIG. 9 is a side view of a post according to an embodiment of the invention.

Referring now to FIG. 9, the exemplary post 14 includes a threaded portion 16. The threaded portion 16 can be received in a threaded aperture defined by or associated with the plate 12. In the exemplary embodiment, a nut 18 is welded on the plate 12. The nut 18 is aligned with an aperture 20 in the plate 12. The threaded portion 16 can be received in the aperture 20 and threadingly engaged with the nut 18.

The exemplary post 14 also includes a base portion 22 having a first diameter and adjacent to the threaded portion 16. The exemplary post 14 also includes a head portion 24 having a second diameter. The exemplary post 14 also includes a neck portion 26 disposed between the base portion 22 and the head portion 24 and having a third diameter less than the first diameter and less than the second diameter.

The exemplary male member 10 also includes first and second apertures 28, 30. The first aperture 28 is disposed in a plane defined by a first flange 32 of the male member 10. The first flange 32 extends in a first plane. The second aperture 30 is disposed in a plane defined by a second flange 34 of the male member 10. The second flange 34 extends in a second plane. The first and second planes are transverse with respect to one another.

FIGS. 5-8 show an exemplary female member 36. The kit also includes at least two female member 36 having a plate 38 and a slot 40 defined by the plate 38. The female member 36 is operable to be embedded within a precast panel. The post 14 is received in the slot 40 when a first precast panel and a second precast panel are slidably engaged with one another, as will be described in greater detail below.

The exemplary slot 40 includes an open end 42 and a closed end 44 spaced from the open end 42 along a slot axis 46. The exemplary slot 40 also includes a first length, referenced at 48, along the slot axis 46 adjacent to the closed end 44 having a first width perpendicular to the slot axis 46. The exemplary slot 40 also includes a second length, referenced at 50, along the slot axis 46 extending between the first length and the closed end 44, wherein the second length has a varying width perpendicular to the slot axis 46.

The exemplary female member 36 also includes first and second apertures 52, 54. The first aperture 52 is disposed in a plane defined by a first flange 56 of the female member 36. The first flange 56 extends in a first plane. The second aperture 54 is disposed in a plane defined by a second flange 58 of the female member 36. The second flange 58 extends in a second plane. The first and second planes are transverse with respect to one another. The slot 40 is disposed in a third plane defined by the plate 38. The third plane intersects the first plane and is parallel to the second plane.

Figure 10:
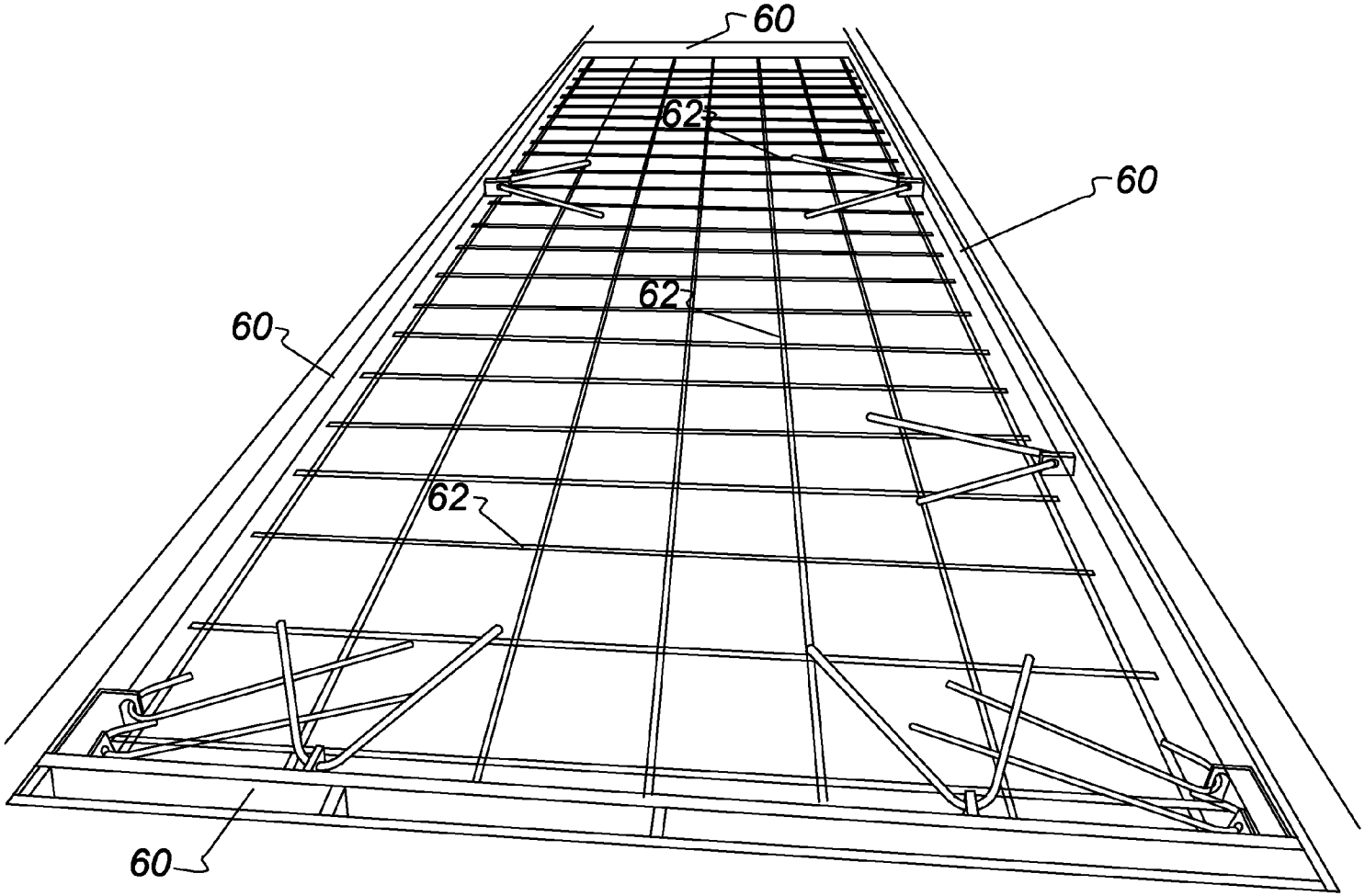
FIG. 10 is a perspective view of a mold and internal components for forming a precast panel.
Figure 11:
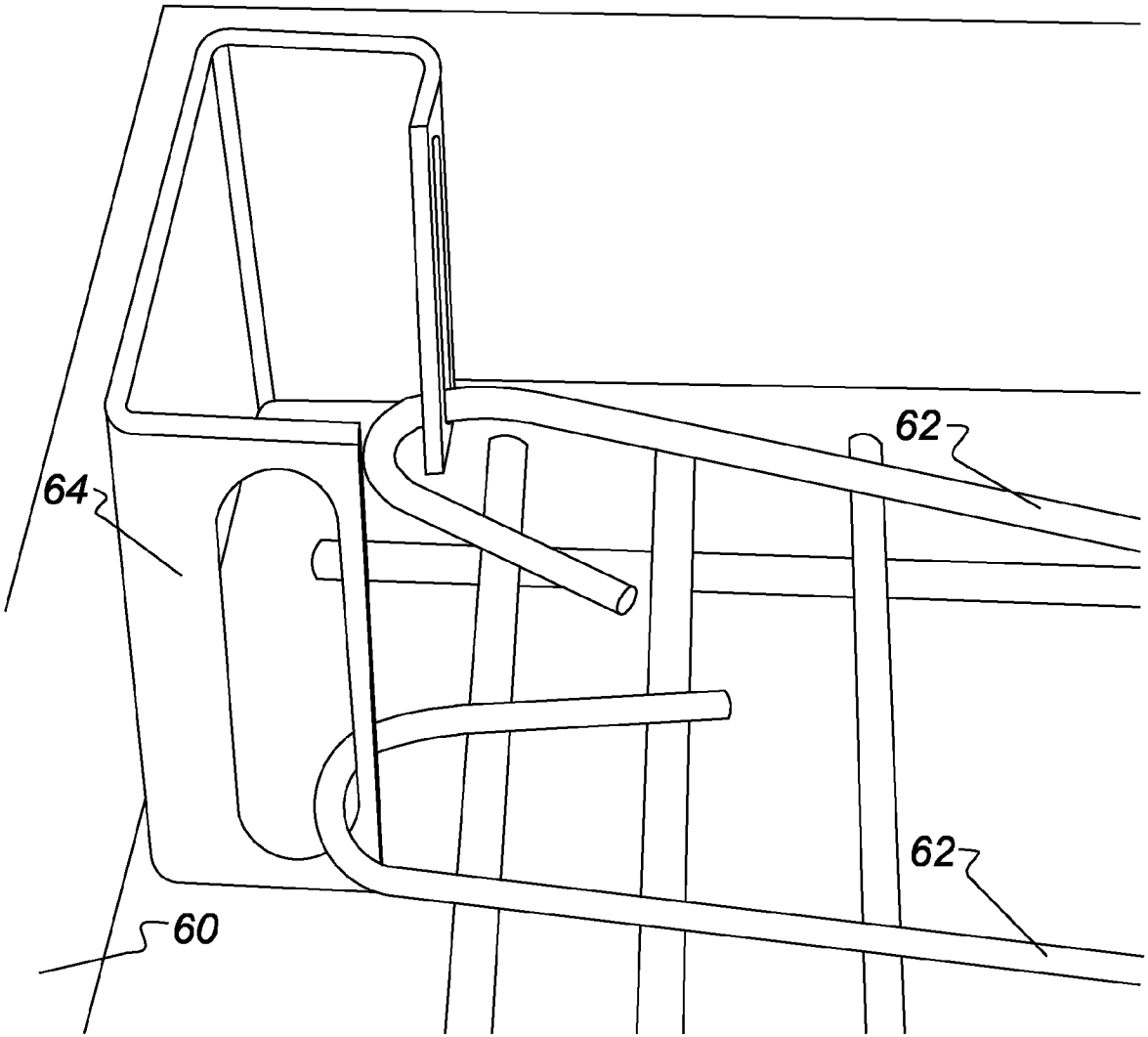
FIG. 11 is a detailed perspective view of one corner of the structure shown in FIG. 10 illustrating the placement of a male or female member of FIG. 1 or 5 located therein.

FIG. 10 shows a casting frame 60 for forming a precast panel. Liquid, unset concrete can be poured into the frame 60 and allowed to set. The concrete can be poured over rebar 62 that will be internal to the precast panel. FIG. 11 shows that portions of rebar 62 can be wound through apertures of the male member and/or the female member. The structure referenced at 64 could be a male member or a female member. Foam or other compressible bodies may be located behind the slot 40 during pouring so as to form a void behind the slot 40 for the head of the post to be received therein.

Figure 12:
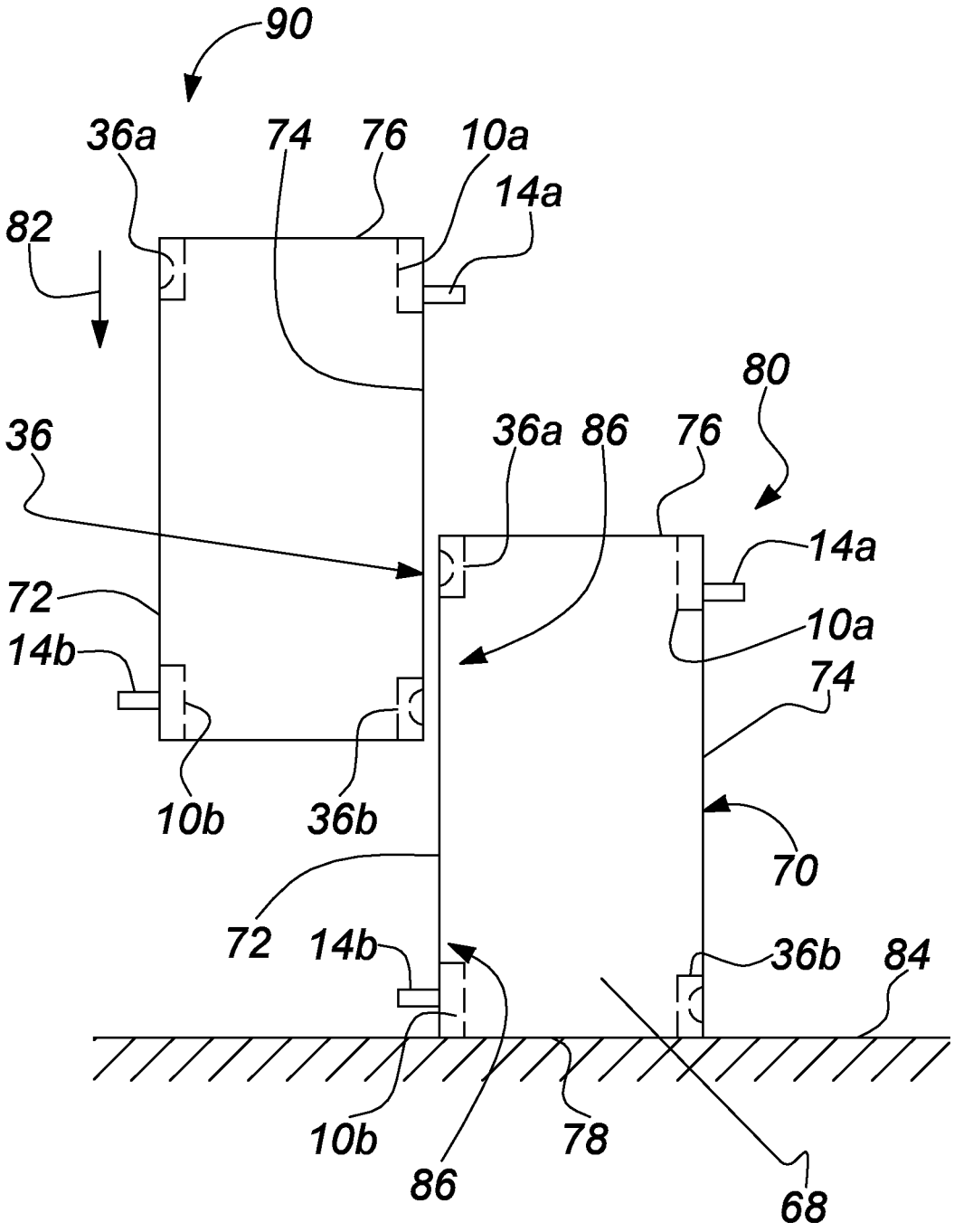
FIG. 12 is a schematic view of two precast panels formed according to an embodiment of the invention being connected together.
Figure 13:
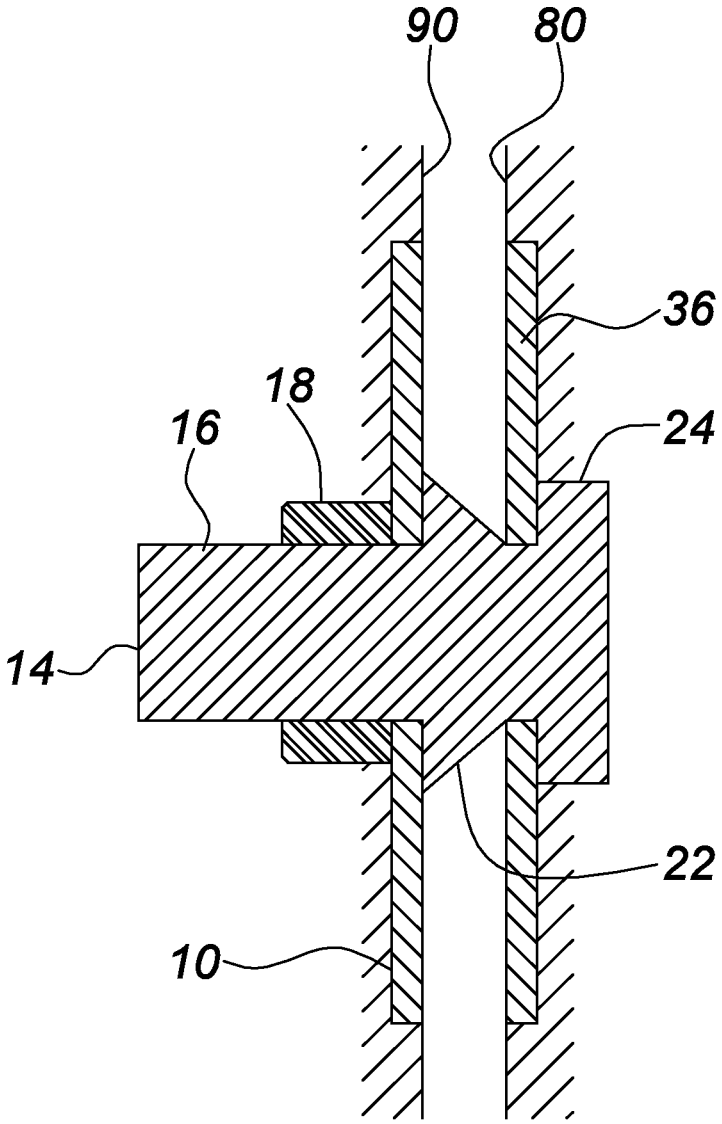
FIG. 13 is a cross sectional view of the connected panels of FIG. 12 as taken through the male and female members.

FIG. 12 is a schematic view of first and second precast panels, 80 and 90, respectively formed according to an embodiment of the invention being connected together. Each precast panel 80 and 90 includes a front 68 and a back (referenced at 70 but not visible in FIG. 12) spaced from the front 68 by a thickness of the precast panel. The precast panel also includes a left edge 72 and a right edge 74, both extending between the front 68 and back 70. The left edge 72 and the right edge 74 are spaced from one another by a width of the precast panel and a top edge 76 and a bottom edge 78, each extending between the front 68 and back 70 and between the left edge 72 and the right edge 74. The bottom edge 78 is spaced from the top edge 76 by a height of the precast panel.

Each first precast panel 80 and 90 includes a first female member **36*a* embedded within the left edge 72 proximate to the top edge 76 and a second female member 36*b* embedded within the right edge 74 proximate to the bottom edge 78 such that the open end 42 of each female member is oriented towards the top edge 76. Each precast panel 80 and 90 also includes a first male member 10*a* and an associated pin 14*a* embedded within the right edge 74 proximate to the top edge 76 so as to correspond to the first female member 36*a* of an adjacent panel and a second male member 10*b* and an associated pin 14*b* embedded within the left edge 72 proximate to the bottom edge 78 so as to correspond to the second female member 36*b* of an adjacent panel. As illustrated in FIG. 12, the first panel 80 may be located on and secured to a foundation or other surface 84. Thereafter, the second panel 90 may be moved in a downward direction generally illustrated as 82 with the head portion 24 of each post received within the slot 40** corresponding to the appropriate location.

When assembled, the post 14 is received within a corresponding slot 40 such that the neck portion 26 is retained within the slot 40 at a position to space the first and second panels 80 and 90 apart from each other by a desired distance, such as approximately ⅜ inch (10 mm) gap as may be required by local codes. The female member 36 may be formed as either a large or a small member as determined by the length of the slot 40. In operation, a large slot may be utilized on the bottom of the panel 80 so as to assist in locating the bottom end **78*a* second panel 90 before the top post is engaged. It will also be appreciated that more than two male and female members 10 and 36** may be utilized wherein the middle female member will also be a short member.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A kit for connecting precast panels comprising:

at least two male member having a plate and a post projecting from said plate; said post comprising a threaded portion threadably engagable within said plate, a tapered base portion having a first diameter and adjacent to said threaded portion, a head portion having a second diameter; and a neck portion disposed between said base portion and said head portion and having a third diameter less than said first diameter and less than said second diameter wherein said base portion tapers down to said neck portion, said post being operable to be embedded within a first panel;

at least two female members having a plate and a slot extending through said plate, said female member operable to be embedded within a second precast panel, wherein said post is received in said slot when said first and second precast panels are slidably engaged with one another.

2. The kit of claim 1 wherein said post is threadingly engaged with said plate.

3. The kit of claim 1 wherein said male members and said female members further include first and second apertures disposed in transverse planes with respect to one another.

4. The kit of claim 1 wherein each of said female members further comprises:

first and second apertures, wherein said first aperture and said second aperture are disposed in respective first and second planes that are transverse with respect to one another and wherein said slot is disposed in a third plane intersecting one of said first and second planes and parallel to the other of said first and second planes.

5. The kit of claim 1 wherein said slot further comprises:

an open end;

a closed end spaced from said open end along a slot axis;

a first length along said slot axis adjacent to said closed end having a first width perpendicular to said slot axis; and a second length along said slot axis extending between said first length and said closed end, wherein said second length has a varying width perpendicular to said slot axis.

6. A precast panel formed with the kit of claim 1 comprising:

a front;

a back spaced from said front by a thickness of said precast panel;

a left edge extending between said front and back;

a right edge extending between said front and back and spaced from said left edge by a width of said precast panel;

a top edge extending between said front and back and between said left edge and said right edge;

a bottom edge extending between said front and back and between said left edge and said right edge and spaced from said top edge by a height of said precast panel;

at least two male members embedded within said precast panel each having a first plate flush with one of said right or left edges and a post projecting therefrom; and at least two first female members embedded within said precast panel each having a first plate and a first slot defined by said first plate flush with the other of said right or left edges.

7. A method of assembling precast panels comprising the steps of:

positioning a first precast panel at a desired position;

positioning a second precast panel adjacent to and offset above said first precast panel such that at least two posts project from a first edge of said second precast panel;

at least two male member having a plate and a post projecting from said plate; said post comprising a threaded portion threadably engagable within said plate, a tapered base portion having a first diameter and adjacent to said threaded portion, a head portion having a second diameter; and a neck portion disposed between said base portion and said head portion and having a third diameter less than said first diameter and less than said second diameter wherein said base portion tapers down to said neck portion;

engaging said at least two posts within corresponding slots defined by at least two female members embedded in said first precast panel; and moving said first precast panel in a downward direction to secure said first and second precast panels together.

* * * * *